US008074983B1

(12) United States Patent
Hsu

(10) Patent No.: US 8,074,983 B1
(45) Date of Patent: Dec. 13, 2011

(54) AUTOMATIC DOCUMENT FEEDER

(75) Inventor: Wei-Hsun Hsu, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 13/009,679

(22) Filed: Jan. 19, 2011

(30) Foreign Application Priority Data

Nov. 12, 2010 (TW) ..... 99138924 A

(51) Int. Cl.
*B65H 5/00* (2006.01)

(52) U.S. Cl. ..... 271/264; 271/273

(58) Field of Classification Search ..... 271/264, 271/272, 273
See application file for complete search history.

(56) References Cited

U.S. PATENT DOCUMENTS 6,206,368 B1 * 3/2001 Kobayashi et al. ..... 271/273
7,448,621 B2 * 11/2008 Yasumoto ..... 271/264
7,637,501 B2 * 12/2009 Akiyama et al. ..... 271/273
2001/0017438 A1 * 8/2001 Takamtsu ..... 271/3.14
2002/0145250 A1 * 10/2002 Chen ..... 271/273
2005/0184454 A1 * 8/2005 Ha ..... 271/264
2007/0228646 A1 * 10/2007 Sekiyama et al. ..... 271/264
2009/0324311 A1 * 12/2009 Matsumoto ..... 399/400

* cited by examiner

*Primary Examiner* — David H Bollinger
(74) *Attorney, Agent, or Firm* — Kirton & McConkie; Evan R. Witt

(57) ABSTRACT

An automatic document feeder includes an outer casing, an upper cover, a first pressing roller set and a separating device. The first pressing roller set is installed in a receiving member, which is arranged at a terminal side of the outer casing. The first pressing roller set includes a first rotating shaft and a first pressing roller. The separating device is sheathed around the first rotating shaft and exposed outside the receiving member. When the upper cover is opened, the upper cover is contacted with the separating device, so that the separating device is moved to shift the first rotating shaft.

11 Claims, 11 Drawing Sheets

AUTOMATIC DOCUMENT FEEDER

FIELD OF THE INVENTION

The present invention relates to an automatic document feeder, and more particularly to an automatic document feeder with a mechanism for removing a jammed paper sheet.

BACKGROUND OF THE INVENTION

An office machine such as a multifunction peripheral and an image scanning apparatus becomes an essential electronic device in the office. For successively feeding many paper sheets to increase the scanning speed, the multifunction peripheral and the image scanning apparatus are usually equipped with an automatic document feeder.

FIG. 1A is a schematic cross-sectional view illustrating a conventional automatic document feeder, which is disclosed in Taiwanese Patent No. TWI255253. As shown in FIG. 1A, the automatic document feeder 1 comprises an outer casing 11, an upper cover 12, a first relay roller 13, a second relay roller 14, a lever 15, a paper guide casing 16 and a paper pick-up module 17. A first end of the lever 15 is connected with the first relay roller 13. A second end of the lever 15 is sustained against a downward protrusion 121 of the upper cover 12. The middle portion of the lever 15 is fixed on a rear side of the first relay roller 13 through a fixing structure 151.

During a scanning operation is performed, the paper sheet to be scanned is transported through the paper guide casing 16 by the paper pick-up module 17, and then the paper sheet is pressed and clamped between the first relay roller 13 and the second relay roller 14 to be fed into internal portion of the automatic document feeder 1.

In a case that the paper sheet is jammed, the upper cover 12 should be uplifted to remove the jammed paper sheet, and then another paper sheet can be fed again to perform the scanning operation. FIG. 1B is a schematic enlarged fragmentary view illustrating a dotted circled portion of the automatic document feeder of FIG. 1A. Hereinafter, the action of the automatic document feeder for removing the jammed paper sheet will be illustrated with reference to FIG. 1B. Firstly, the upper cover 12 is rotated in the directional. Correspondingly, the second end of the lever 15 is pushed by the protrusion 121 of the upper cover 12, and the lever 15 is rotated in the direction a2 by using the middle portion of the lever 15 as a fulcrum. As the lever 15 is rotated in the direction a2, the first relay roller 13 is correspondingly moved in the direction a3, so that the first relay roller 13 is separated from the second relay roller 14. Meanwhile, the jammed paper sheet may be pulled out of the automatic document feeder 1 without difficulty.

From the above discussions, in the conventional automatic document feeder 1, the jammed paper sheet may be removed when the upper cover 12 is opened and the first relay roller 13 is separated from the second relay roller 14 through the lever 15.

The conventional automatic document feeder 1, however, still has some drawbacks. For example, since the lever 15 is fixed on the rear side of the first relay roller 13 through the fixing structure 151 and the lever 15 is sustained against the protrusion 121 of the upper cover 12, it is necessary for the conventional automatic document feeder 1 to provide an additional space to accommodate the lever 15 in order to achieve the function of removing the jammed paper sheet. As shown in FIG. 1, since there is an additional space at the rear side of the first relay roller 13, the overall volume of the conventional automatic document feeder 1 is increased.

Therefore, there is a need of providing an improved automatic document feeder so as to obviate the drawbacks encountered from the prior art.

SUMMARY OF THE INVENTION

The present invention provides an automatic document feeder with a reduced space for installing a jammed-paper removing mechanism.

In accordance with an aspect of the present invention, there is provided an automatic document feeder for feeding a paper sheet. The automatic document feeder includes an outer casing, an upper cover, a first pressing roller set and a separating device. The outer casing includes a receiving member. The receiving member is arranged at a terminal side of the outer casing, and includes a first perforation and a second perforation. The upper cover is pivotally coupled to the terminal side of the outer casing, so that the upper cover is rotatable with respect to the outer casing to be selectively opened or closed. The first pressing roller set is disposed within the receiving member, and includes a first rotating shaft and a first pressing roller. The first rotating shaft is disposed within the receiving member. The first pressing roller is sheathed around the first rotating shaft and partially protruded out of the first perforation, so that the first rotating roller is exposed outside the receiving member. The separating device is sheathed around the first rotating shaft and partially protruded out of the second perforation, so that the separating device is exposed outside the receiving member. When the upper cover is opened, the upper cover is contacted with the separating device, so that the separating device is moved to shift the first rotating shaft.

In an embodiment, the automatic document feeder further includes a paper guide casing and a paper pick-up module. The paper guide casing is disposed on the outer casing to define a paper-feeding path for guiding the paper sheet to be fed into an internal portion of the automatic document feeder. The paper pick-up module is disposed over the paper guide casing for transporting the paper sheet through the paper guide casing.

In an embodiment, the automatic document feeder further includes a second pressing roller set, which is installed in the paper guide casing. The second pressing roller set includes a second rotating shaft and a second pressing roller. The second pressing roller and the first pressing roller are pressed by each other to clamp the paper sheet, so that the paper sheet is fed into the internal portion of the automatic document feeder.

In an embodiment, the automatic document feeder further includes a fixing device, which is installed in the receiving member for fixing the first pressing roller set in the receiving member.

In an embodiment, a first end of the separating device is disposed on the fixing device, a second end of the separating device is protruded out of the second perforation of the receiving member, a position-confining hole is formed in a middle portion of the separating device, and the first rotating shaft is penetrated through the position-confining hole. When the upper cover is opened, the second end of the separating device is pressed by the upper cover, so that the separating device is rotated by using the first end of the separating device as a fulcrum. As the separating device is rotated, the first rotating shaft is shifted, so that the first pressing roller is separated from the second pressing roller to facilitate removing the paper sheet which is jammed in the automatic document feeder.

In an embodiment, plural paper guide slices are further disposed on the upper cover. When the upper cover is opened, the second end of the separating device is pressed by one of the paper guide slices, so that the first pressing roller is separated from the second pressing roller through the separating device.

In an embodiment, a position-confining hole is formed in a first end of the separating device, the first rotating shaft is penetrated through the position-confining hole, a second end of the separating device is protruded out of the second perforation of the receiving member, a concave structure is formed in a middle portion of the separating device, and a convex structure is formed in the second perforation. When the upper cover is opened, the second end of the separating device is pushed by the upper cover, and the concave structure of the separating device and the convex structure of the second perforation are pressed by each other, so that the separating device is rotated by using the middle portion of the separating device as a fulcrum. As the separating device is rotated, the first rotating shaft is shifted, so that the first pressing roller is separated from the second pressing roller to facilitate removing the paper sheet which is jammed in the automatic document feeder.

In an embodiment, the upper cover further includes a bulge. When the upper cover is opened, the second end of the separating device is pushed by the bulge of the upper cover, so that the first pressing roller is separated from the second pressing roller through the separating device.

In an embodiment, plural paper guide slices are further disposed on a surface of the receiving member.

In an embodiment, the automatic document feeder further includes an elastic element, which is installed on the first rotating shaft to provide a restoring force to the first rotating shaft.

In an embodiment, the elastic element is a double-torsion spring.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides an automatic document feeder. The automatic document feeder is applied to a multi-function peripheral or an automatic sheetfed scanner.

Figure 1A:
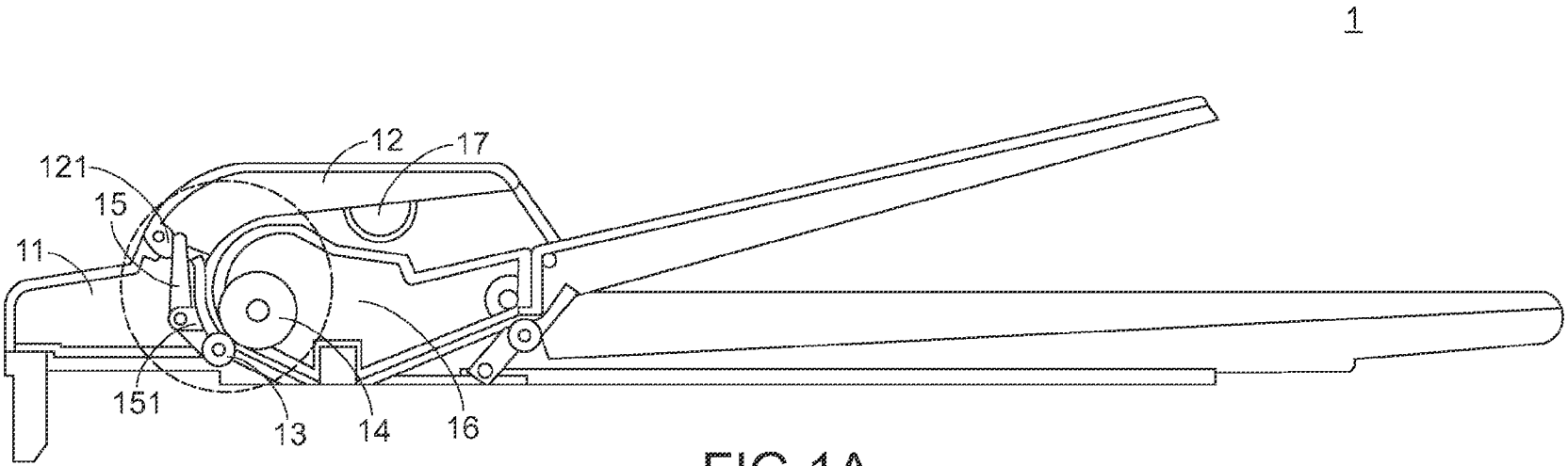
FIG. 1A PRIOR ART
FIG. 1A is a schematic cross-sectional view illustrating a conventional automatic document feeder.
Figure 1B:
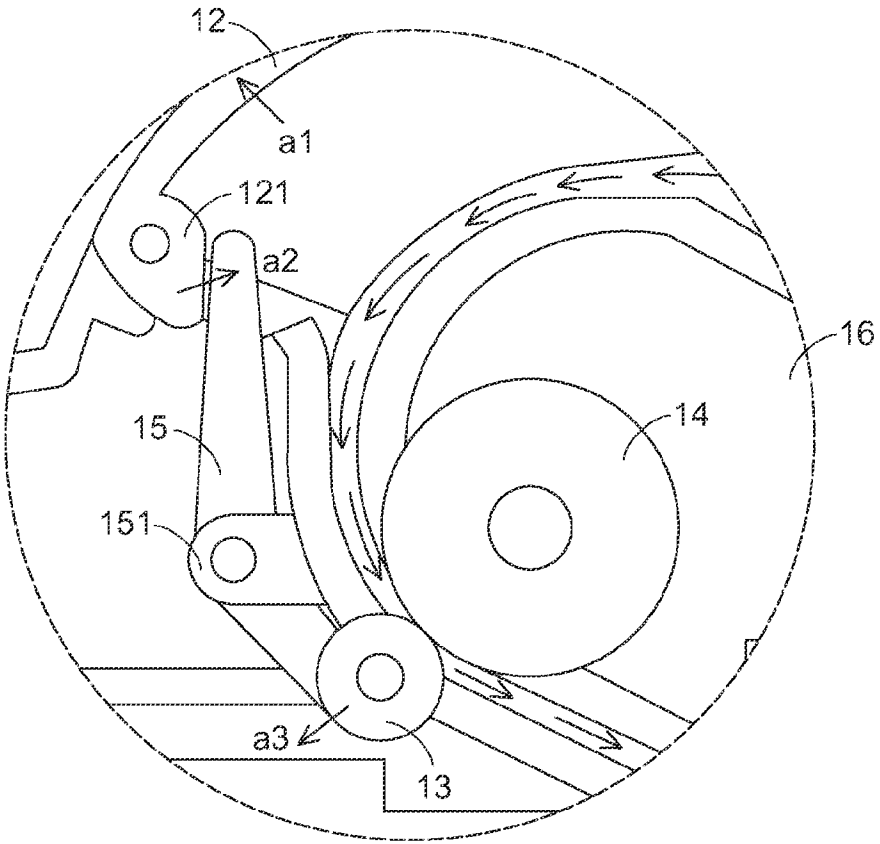
FIG.1B PRIOR ART
FIG. 1B is a schematic enlarged fragmentary view illustrating a dotted circled portion of the automatic document feeder of FIG. 1A.
Figure 2:
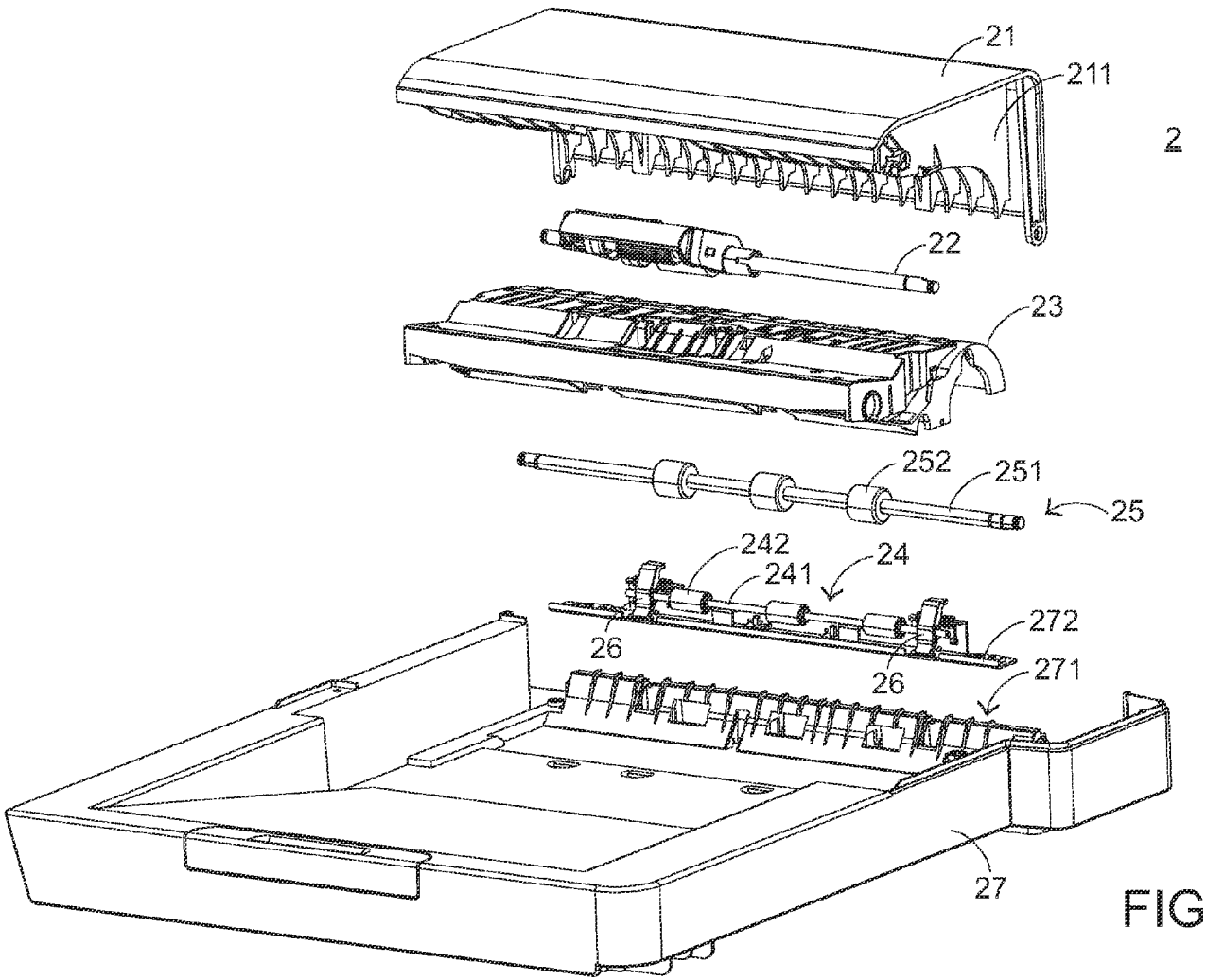
FIG. 2 is a schematic exploded view illustrating an automatic document feeder according to a first embodiment of the present invention.

FIG. 2 is a schematic exploded view illustrating an automatic document feeder according to a first embodiment of the present invention. As shown in FIG. 2, the automatic document feeder 2 comprises an upper cover 21, a paper pick-up module 22, a paper guide casing 23, a first pressing roller set 24, a second pressing roller set 25, two separating devices 26 and an outer casing 27. The upper cover 21 comprises plural paper guide slices 211. A receiving member 271 is arranged at a terminal side of the outer casing 27. In this embodiment, the first pressing roller set 24 comprises a first rotating shaft 241 and three first pressing rollers 242. The second pressing roller set 25 comprises a second rotating shaft 251 and three second pressing rollers 252. A fixing device 272, the first pressing roller set 24 and the two separating devices 26 are installed in the receiving member 271, which is arranged at the terminal side of the outer casing 27.

Figure 3A:
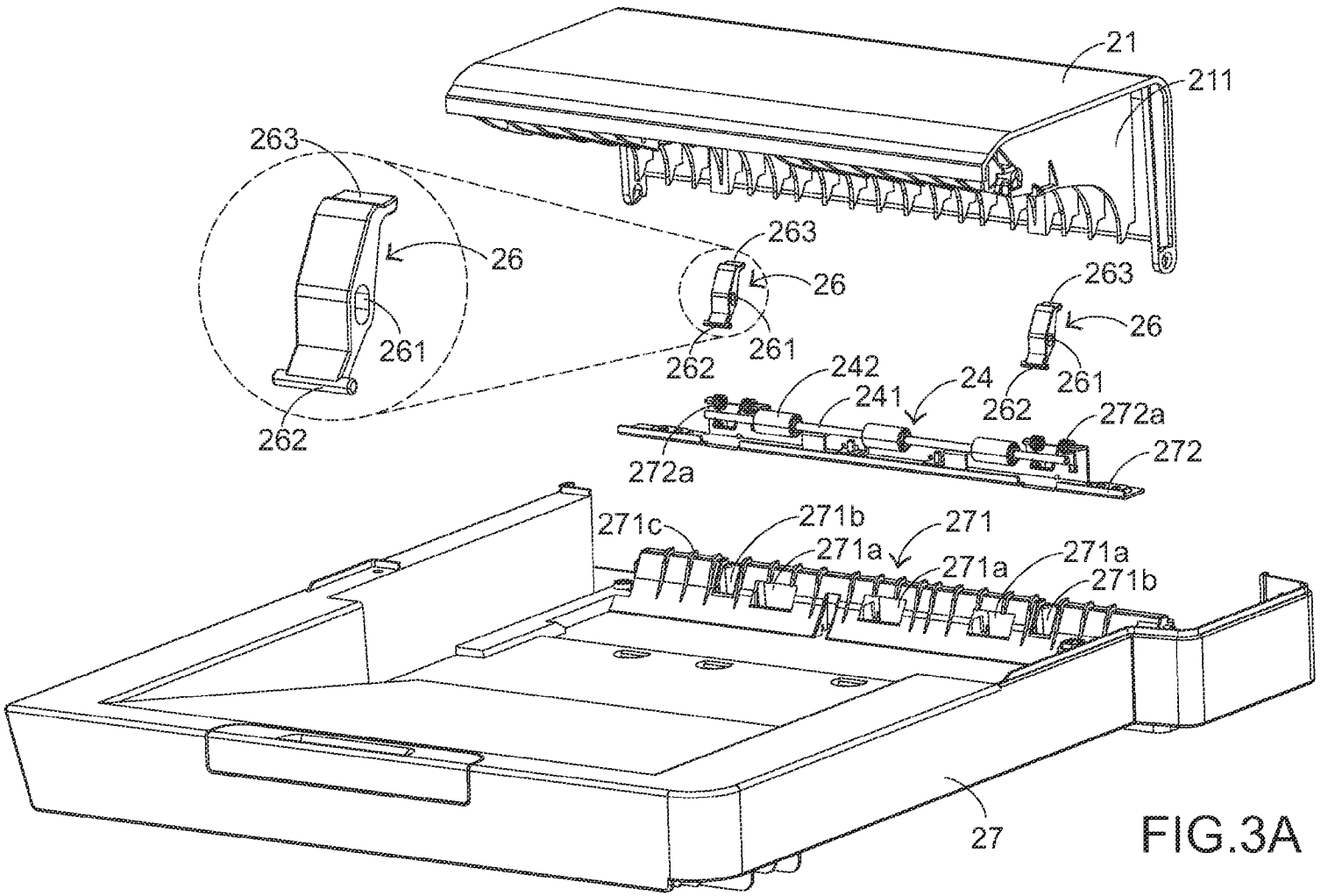
FIG. 3A is a schematic exploded view illustrating a portion of the automatic document feeder according to the first embodiment of the present invention.
Figure 3B:
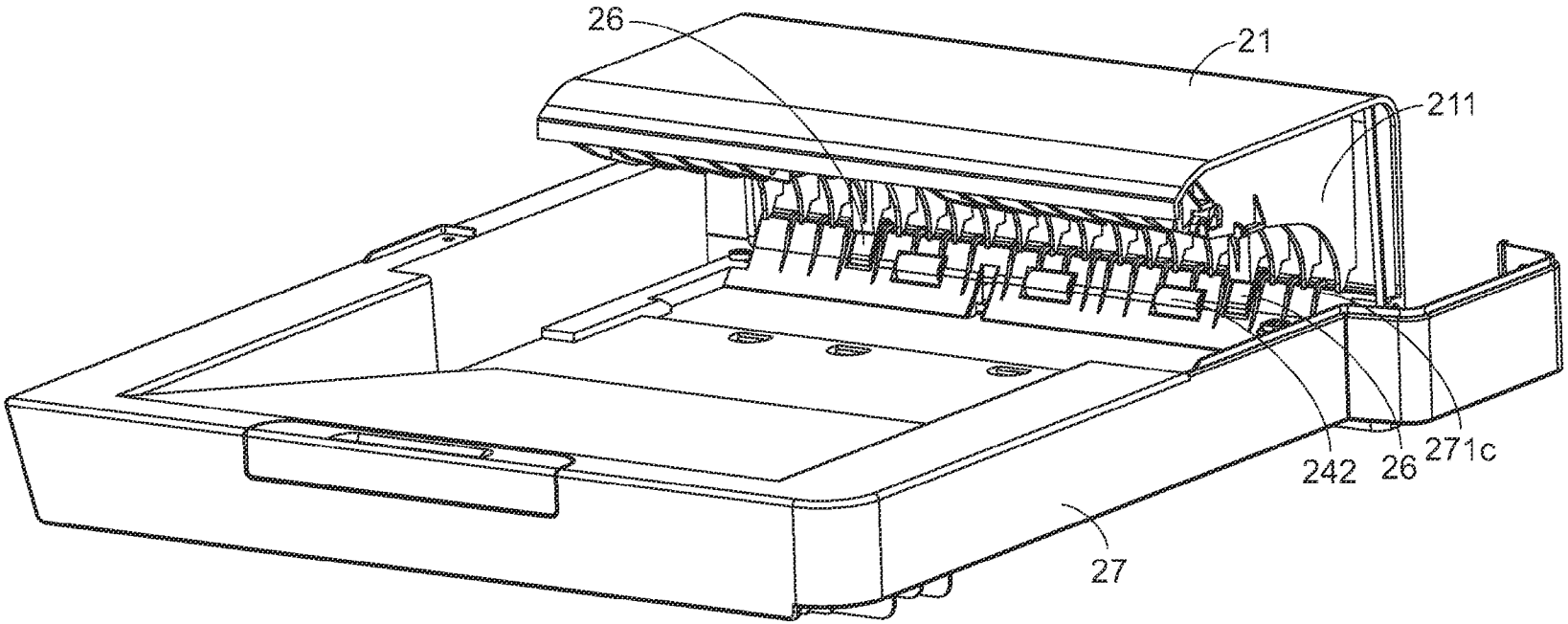
FIG. 3B is a schematic assembled view illustrating a portion of the automatic document feeder according to the first embodiment of the present invention.

Please refer to FIGS. 3A and 3B. The upper cover 21 is pivotally coupled to the terminal side of the outer casing 27 and disposed over the receiving member 271. The first rotating shaft 241 is disposed on the fixing device 272. The three first pressing rollers 242 are sheathed around the first rotating shaft 241. The two separating devices 26 have respective position-confining holes 261 in the middle portions thereof. The first rotating shaft 241 is penetrated through the position-confining holes 261. The first ends 262 of the separating devices 26 are fixed on the fixing device 272. The fixing device 272 is installed in the receiving member 271. In this embodiment, the receiving member 271 comprises three first perforations 271*a*, two second perforations 271*b* and plural paper guide slices 271*c*, which are disposed on the surface of the receiving member 271. The three first pressing rollers 242 are partially protruded out of the first perforations 271*a*, and thus exposed outside the receiving member 271. The second ends 263 of the separating devices 26 are respectively protruded out of the second perforations 271, and thus exposed outside the receiving member 271. In addition, the second ends 263 of the separating devices 26 are arranged under respective paper guide slices 211 of the upper cover 21. In the embodiment of FIG. 3, the automatic document feeder 2 further comprises two elastic elements 272*a*. These elastic elements 272*a* are disposed on the fixing device 272 for providing restoring forces to the first rotating shaft 241. In this embodiment, the two elastic elements 272*a* are double-torsion springs.

Hereinafter, the operations of the automatic document feeder 2 of FIG. 3A will be illustrated with reference to FIGS. 4A and 4B.

Figure 4A:
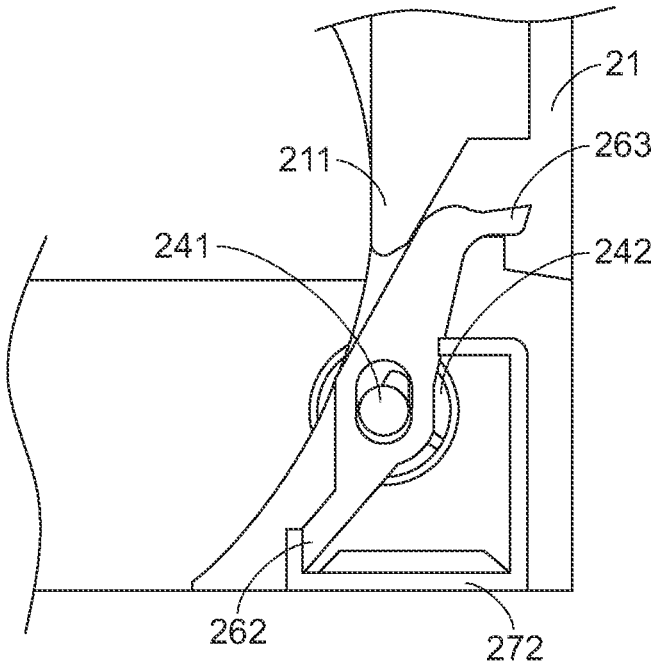
FIG. 4A is a schematic cross-sectional view illustrating the automatic document feeder in a paper-feeding mode according to the first embodiment of the present invention.

FIG. 4A is a schematic cross-sectional view illustrating the automatic document feeder in a paper-feeding mode according to the first embodiment of the present invention. During a paper-feeding operation is performed, the upper cover 21 is closed, and the paper sheet to be scanned is transported through the paper guide casing 23 by the paper pick-up module 22. Then, the paper sheet is pressed and clamped between the three first pressing rollers 242 and the three second pressing rollers 252 to be fed into internal portion of the automatic document feeder 2 to perform a scanning operation. Moreover, the plural paper guide slices 211 of the upper cover 21 and the plural paper guide slices 271*c* on the surface of the receiving member 271 collectively define a smooth paper-feeding path in order to prevent from damage of the paper sheet. In this situation, the second ends 263 of the two separating devices 26 are not pressed by the upper cover 21; the two separating devices 26 are exposed outside the receiving member 27; and each of the separating devices 26 is arranged between two of the paper guide slices 271*c* of the receiving member 271 without adversely affecting the paper-guiding function of the paper guide slices 271*c*. In a case that the paper sheet is suffered from misalignment or unevenness during the scanning process, the paper sheet may be jammed in the region between the three first pressing rollers 242 and the three second pressing rollers 252. If the paper sheet fails to be continuously advanced, the jammed paper sheet needs to be removed from the automatic document feeder 2 in order to continuously perform the scanning operation.

Figure 4B:
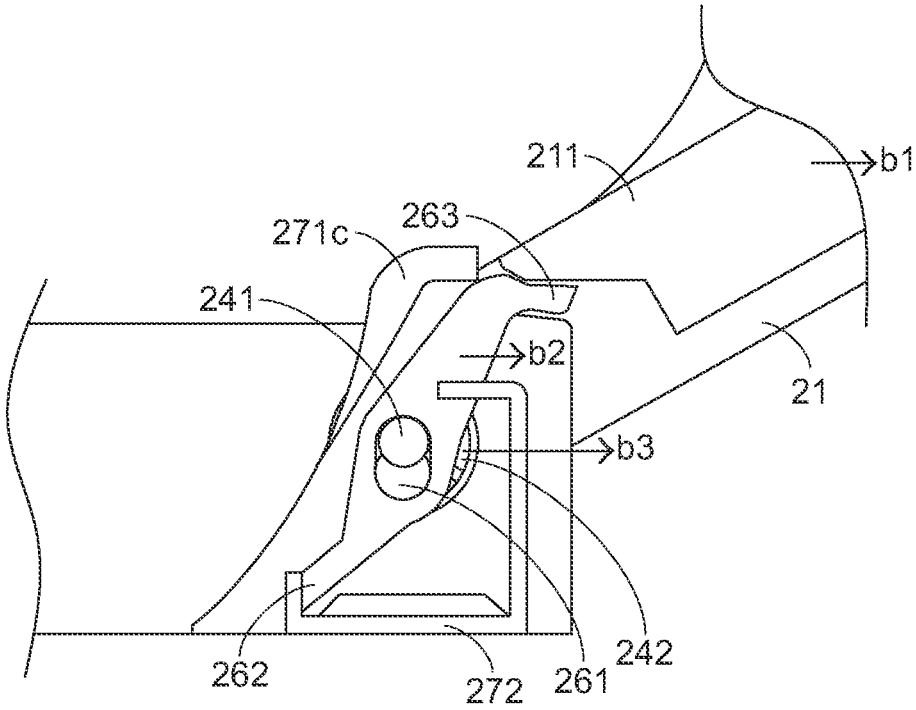
FIG. 4B is a schematic cross-sectional view illustrating the automatic document feeder in a jammed-paper removing mode according to the first embodiment of the present invention.

FIG. 4B is a schematic cross-sectional view illustrating the automatic document feeder in a jammed-paper removing mode according to the first embodiment of the present invention. For removing the jammed paper sheet, the upper cover 21 needs to be opened. When the upper cover 21 is opened in the direction b1, the second ends 263 of the separating devices 26 are pressed by the paper guide slices 211 of the upper cover 21. Consequently, the separating devices 26 are rotated in the direction b2 by using the first ends 262 of the separating devices 26 as the fulcrums. As the separating devices 26 are rotated in the direction b2, the both ends of the first rotating shaft 241 are respectively glided within the position-confining holes 261 to a fixed position. Meanwhile, the first rotating shaft 241 is shifted to have the three first pressing rollers 242 move in the direction b3, and thus the three first pressing rollers 242 are separated from the three second pressing rollers 252. Under this circumstance, the user may remove the jammed paper sheet without causing damage to the jammed paper sheet. Moreover, by adjusting the sizes of the position-confining holes 261 of the separating devices 26, the shifting extent of the first rotating shaft 241 may be changed. After the upper cover 21 is closed and the scanning operation is performed again, due to the restoring forces provided to the first rotating shaft 24 by the two elastic elements 272*a*, the first rotating shaft 24 will be returned to the original position. Since the two separating devices 26 are moved with the first rotating shaft 24, the two separating devices 26 are also returned to their original statuses.

Figure 5:
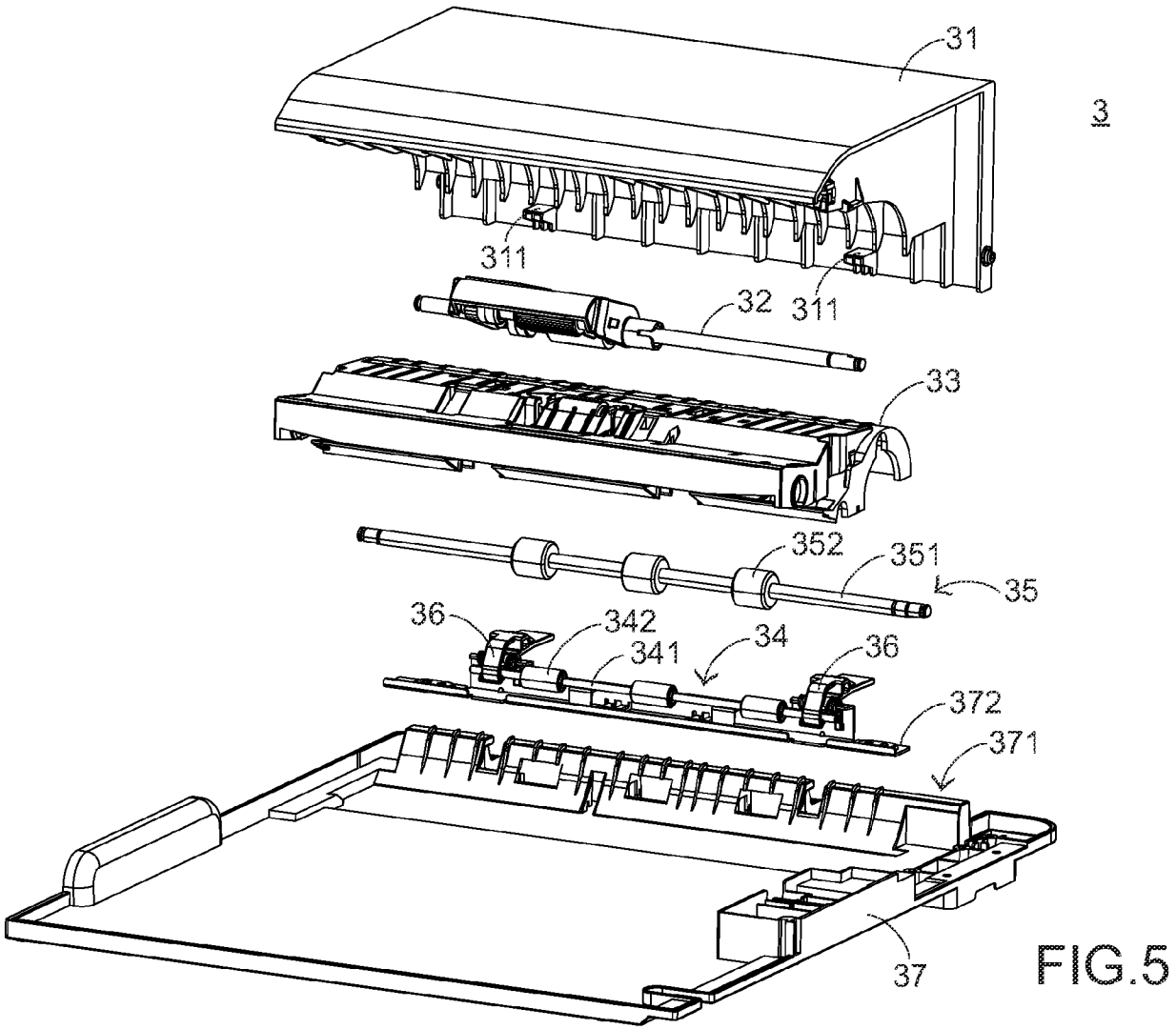
FIG. 5 is a schematic exploded view illustrating an automatic document feeder according to a second embodiment of the present invention.

The present invention also provides a second embodiment. FIG. 5 is a schematic exploded view illustrating an automatic document feeder according to a second embodiment of the present invention. As shown in FIG. 5, the automatic document feeder 3 comprises an outer casing 31, a paper pick-up module 32, a paper guide casing 33, a first pressing roller set 34, a second pressing roller set 35, two separating devices 36 and an outer casing 37. The upper cover 31 comprises two bulges 311. A receiving member 371 is arranged at a terminal side of the outer casing 37. In this embodiment, the first pressing roller set 34 comprises a first rotating shaft 341 and three first pressing rollers 342. The second pressing roller set 35 comprises a second rotating shaft 351 and three second pressing rollers 352. A fixing device 372, the first pressing roller set 34 and the two separating devices 36 are installed in the receiving member 371, which is arranged at the terminal side of the outer casing 37. In comparison with the first embodiment, the configurations and the positions of the two separating devices 36 are distinguishable.

Figure 6A:
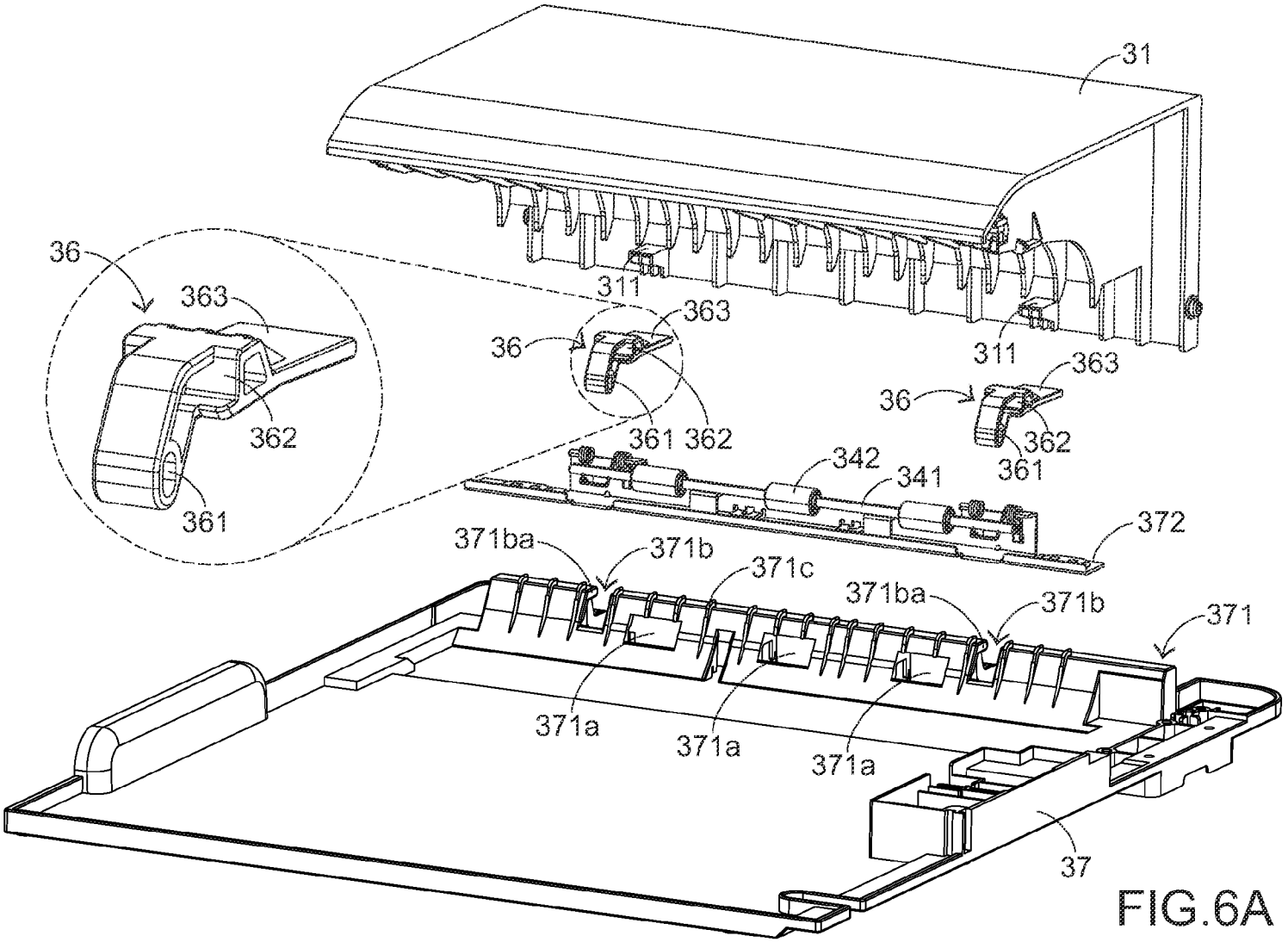
FIG. 6A is a schematic exploded view illustrating a portion of the automatic document feeder according to the second embodiment of the present invention.
Figure 6B:
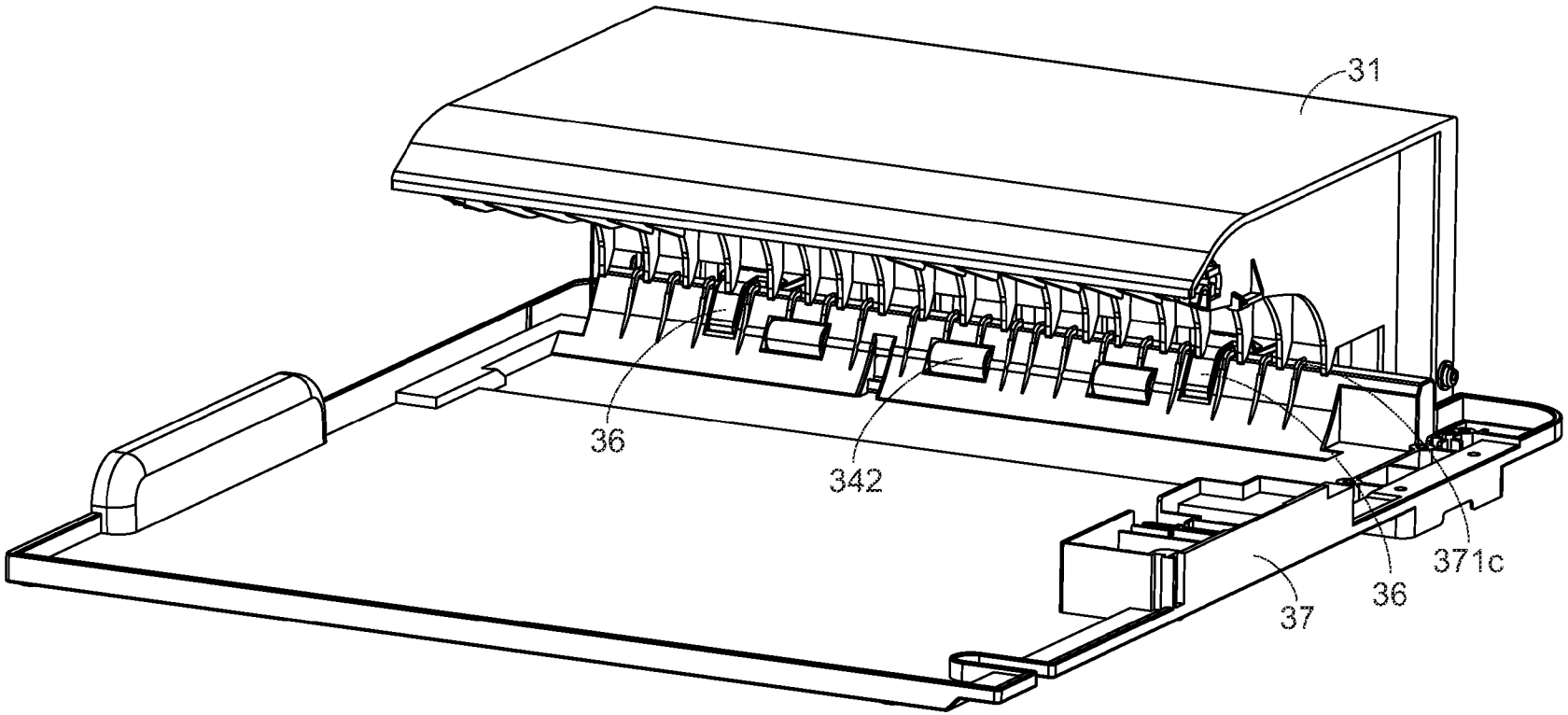
FIG. 6B is a schematic assembled view illustrating a portion of the automatic document feeder according to the second embodiment of the present invention.

Please refer to FIGS. 6A and 6B. The upper cover 31 is pivotally coupled to the terminal side of the outer casing 37 and disposed over the receiving member 371. The first rotating shaft 341 is disposed on the fixing device 372. The three first pressing rollers 342 are sheathed around the first rotating shaft 341. The first ends of the two separating devices 36 have respective position-confining holes 361. The first rotating shaft 341 is penetrated through the position-confining holes 361. In addition, two concave structures 362 are respectively formed in the middle portions of the two separating devices 36. The fixing device 372 is installed in the receiving member 371. In this embodiment, the receiving member 371 comprises three first perforations 371*a*, two second perforations 371*b* and plural paper guide slices 371*c*, which are disposed on the surface of the receiving member 371. In addition, two convex structures 371*ba* are respectively formed in the two second perforations 371*b*. The three first pressing rollers 342 are partially protruded out of the first perforations 371*a*, and thus exposed outside the receiving member 371. The second ends 363 of the separating devices 36 are respectively protruded out of the second perforations 371, and thus exposed outside the receiving member 371. In addition, the second ends 363 of the separating devices 36 are respectively arranged under the two bulges 311 of the upper cover 31. The concave structures 362, which are respectively formed in the middle portions of the two separating devices 36, are arranged beside the convex structures 371*ba* of the second perforations 371*b* and under the convex structures 371*ba*.

Figure 7A:
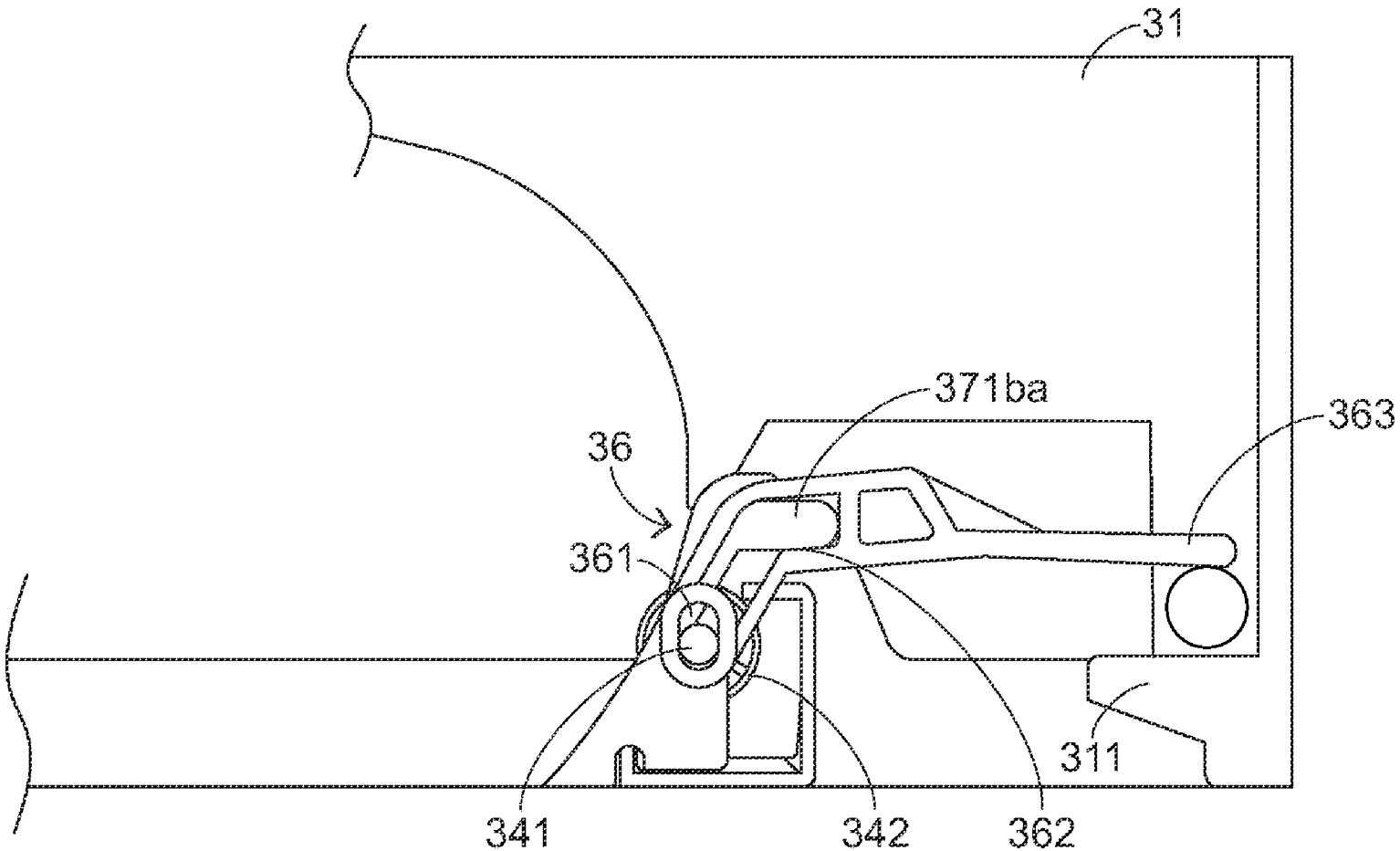
FIG. 7A is a schematic cross-sectional view illustrating the automatic document feeder in a paper-feeding mode according to the second embodiment of the present invention.
Figure 7B:
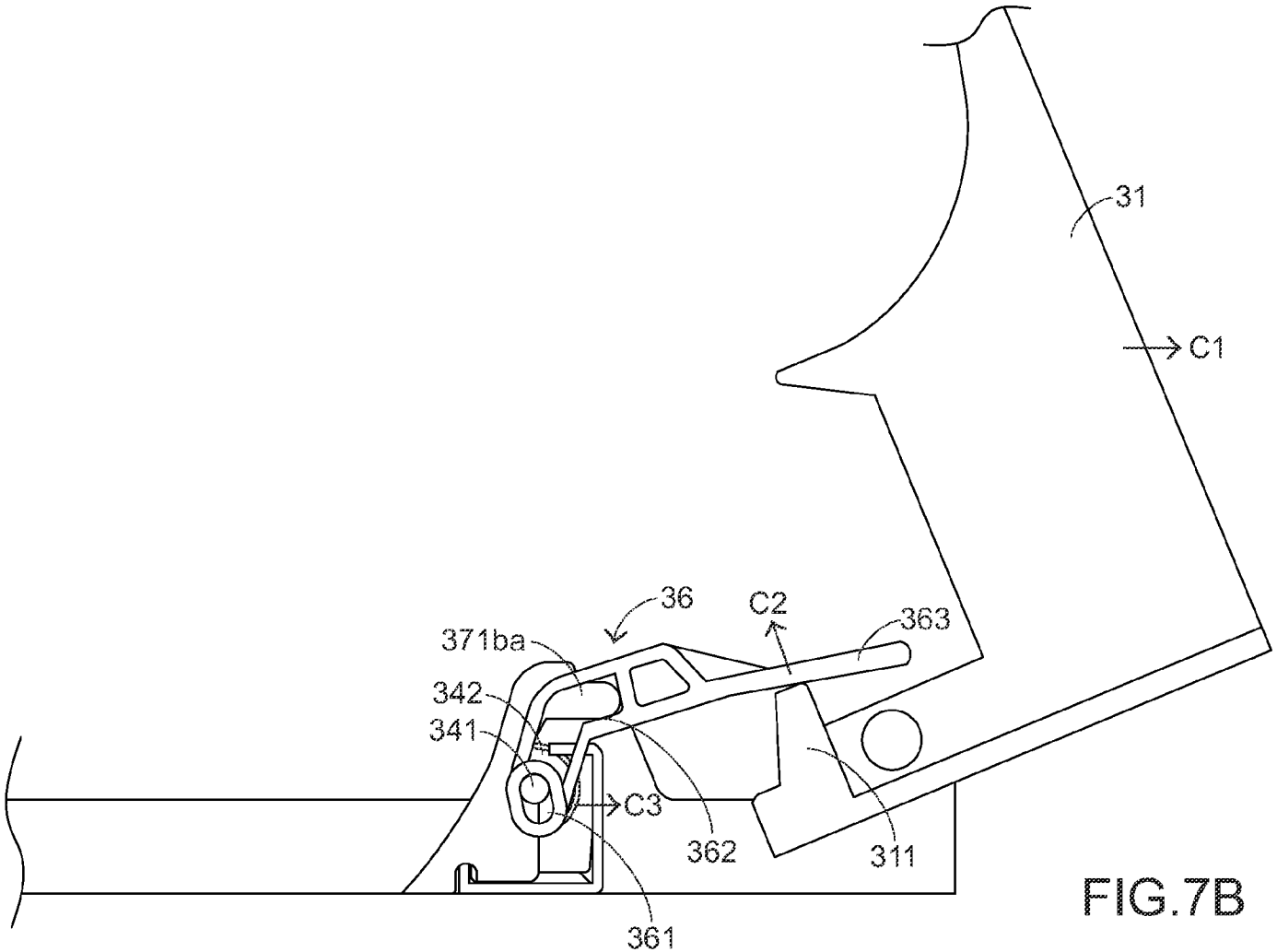
FIG. 7B is a schematic cross-sectional view illustrating the automatic document feeder in a jammed-paper removing mode according to the second embodiment of the present invention.

Hereinafter, the operations of the automatic document feeder of FIG. 6A will be illustrated with reference to FIGS. 7A and 7B. When the upper cover 31 is opened in the direction c1, the second ends 363 of the separating devices 36 are pushed by the bulges 311 of the upper cover 31. Meanwhile, the two concave structures 362, which are respectively formed in the middle portions of the two separating devices 36, are moved upwardly to press the convex structures 371*ba* of the second perforations 371*b*. Consequently, the concave structures 362 are no longer shifted, and the separating devices 36 are rotated in the direction c2 by using the concave structures 362 of the middle portion of the separating devices 36 as the fulcrums. As the separating devices 26 are rotated in the direction c2, the both ends of the first rotating shaft 341 are respectively glided within the position-confining holes 361 to a fixed position. Meanwhile, the first rotating shaft 341 is shifted to have the three first pressing rollers 342 move in the direction c3, and thus the three first pressing rollers 342 are separated from the three second pressing rollers 352. The configurations and operating principles of other components of the automatic document feeder 3 are similar to those of the first embodiment, and are not redundantly described herein.

As is found from the above two embodiments, if the paper sheet is jammed in the automatic document feeder of the present invention, the jammed paper sheet can be easily removed by means of the separating devices without harming the paper sheet or damaging the automatic document feeder. Moreover, since the separating devices and the first pressing roller are installed in the same receiving member, it is not necessary to provide an additional space to install the separating devices to remove the jammed paper sheet. In such way, since the installing space is saved, the automatic document feeder of the present invention can meet the modern requirements (e.g. small size and light weightiness).

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder for feeding a paper sheet, said automatic document feeder comprising:

an outer casing comprising a receiving member, wherein said receiving member is arranged at a terminal side of said outer casing, and comprises a first perforation and a second perforation;

an upper cover pivotally coupled to said terminal side of said outer casing, so that said upper cover is rotatable with respect to said outer casing to be selectively opened or closed;

a first pressing roller set disposed within said receiving member, and comprising a first rotating shaft and a first pressing roller, wherein said first rotating shaft is disposed within said receiving member, and said first pressing roller is sheathed around said first rotating shaft and partially protruded out of said first perforation, so that said first rotating roller is exposed outside said receiving member; and a separating device sheathed around said first rotating shaft and partially protruded out of said second perforation, so that said separating device is exposed outside said receiving member, wherein when said upper cover is opened, said upper cover is contacted with said separating device, so that said separating device is moved to shift said first rotating shaft.

2. The automatic document feeder according to claim 1 further comprising:

a paper guide casing disposed on said outer casing to define a paper-feeding path for guiding said paper sheet to be fed into an internal portion of said automatic document feeder; and a paper pick-up module disposed over said paper guide casing for transporting said paper sheet through said paper guide casing.

3. The automatic document feeder according to claim 2 further comprising a second pressing roller set, which is installed in said paper guide casing, wherein said second pressing roller set comprises a second rotating shaft and a second pressing roller, wherein said second pressing roller and said first pressing roller are pressed by each other to clamp said paper sheet, so that said paper sheet is fed into said internal portion of said automatic document feeder.

4. The automatic document feeder according to claim 1 further comprising a fixing device, which is installed in said receiving member for fixing said first pressing roller set in said receiving member.

5. The automatic document feeder according to claim 4 wherein a first end of said separating device is disposed on said fixing device, a second end of said separating device is protruded out of said second perforation of said receiving member, a position-confining hole is formed in a middle portion of said separating device, and said first rotating shaft is penetrated through said position-confining hole, wherein when said upper cover is opened, said second end of said separating device is pressed by said upper cover, so that said separating device is rotated by using said first end of said separating device as a fulcrum, wherein as said separating device is rotated, said first rotating shaft is shifted, so that said first pressing roller is separated from said second pressing roller to facilitate removing said paper sheet which is jammed in said automatic document feeder.

6. The automatic document feeder according to claim 5 wherein plural paper guide slices are further disposed on said upper cover, wherein when said upper cover is opened, said second end of said separating device is pressed by one of said paper guide slices, so that said first pressing roller is separated from said second pressing roller through said separating device.

7. The automatic document feeder according to claim 1 wherein a position-confining hole is formed in a first end of said separating device, said first rotating shaft is penetrated through said position-confining hole, a second end of said separating device is protruded out of said second perforation of said receiving member, a concave structure is formed in a middle portion of said separating device, and a convex structure is formed in said second perforation, wherein when said upper cover is opened, said second end of said separating device is pushed by said upper cover, and said concave structure of said separating device and said convex structure of said second perforation are pressed by each other, so that said separating device is rotated by using said middle portion of said separating device as a fulcrum, wherein as said separating device is rotated, said first rotating shaft is shifted, so that said first pressing roller is separated from said second pressing roller to facilitate removing said paper sheet which is jammed in said automatic document feeder.

8. The automatic document feeder according to claim 7 wherein said upper cover further comprises a bulge, wherein when said upper cover is opened, said second end of said separating device is pushed by said bulge of said upper cover, so that said first pressing roller is separated from said second pressing roller through said separating device.

9. The automatic document feeder according to claim 1 wherein plural paper guide slices are further disposed on a surface of said receiving member.

10. The automatic document feeder according to claim 1 further comprising an elastic element, which is installed on said first rotating shaft to provide a restoring force to said first rotating shaft.

11. The automatic document feeder according to claim 10 wherein said elastic element is a double-torsion spring.

* * * * *